US007614240B2

(12) United States Patent
Rampersad

(10) Patent No.: US 7,614,240 B2
(45) Date of Patent: Nov. 10, 2009

(54) CONTROL METHOD FOR PULSE TUBE CRYOCOOLER

(75) Inventor: Bryce Mark Rampersad, Cheektowaga, NY (US)

(73) Assignee: Praxair Technology, Inc., Danbury, CT (US)

( * ) Notice: Subject to any disclaimer, the term of this patent is extended or adjusted under 35 U.S.C. 154(b) by 438 days.

(21) Appl. No.: 11/524,877

(22) Filed: Sep. 22, 2006

(65) Prior Publication Data

US 2008/0072608 A1 Mar. 27, 2008

(51) Int. Cl.
*F25B 9/00* (2006.01)
*F25B 49/00* (2006.01)

(52) U.S. Cl. ..... 62/6; 62/228.1

(58) Field of Classification Search ..... 62/6, 62/228.1

See application file for complete search history.

(56) References Cited

U.S. PATENT DOCUMENTS

| | | | | |
|---|---|---|---|---|
| 5,535,593 | A * | 7/1996 | Wu et al. | 62/6 |
| 5,701,743 | A * | 12/1997 | Hagiwara et al. | 62/6 |
| 6,021,643 | A | 2/2000 | Swift et al. | 62/6 |
| 6,094,921 | A * | 8/2000 | Zhu et al. | 62/6 |
| 6,393,845 | B1 * | 5/2002 | Nogawa et al. | 62/6 |
| 6,666,033 | B1 | 12/2003 | Swift et al. | 62/6 |
| 2003/0226364 | A1 | 12/2003 | Swift et al. | |
| 2004/0045315 | A1 | 3/2004 | Kamoshita et al. | |
| 2006/0086098 | A1 * | 4/2006 | Kirkconnell et al. | 62/6 |
| 2006/0277925 | A1 * | 12/2006 | Matsubara et al. | 62/6 |
| 2006/0288710 | A1 * | 12/2006 | Legall et al. | 62/6 |

FOREIGN PATENT DOCUMENTS

| | | |
|---|---|---|
| JP | 08254365 | 10/1996 |
| JP | 2002061976 | 2/2002 |
| JP | 2002228287 | 8/2002 |
| JP | 2003148825 | 5/2003 |
| JP | 2004301445 | 10/2004 |
| JP | 2004353967 | 12/2004 |

OTHER PUBLICATIONS

Zhu, et al., "Investigation of active-buffer pulse tube refrigerator", Cryogenics 37, 1997, pp. 461-471.
Gardner et al., "Use of inertance in orifice pulse tube refrigerators", Cryogenics 37, 1997, pp. 117-121.
Huang et al., "A pulse-tube refrigerator using variable-resistance orifice", Cryogenics 43, 2003, pp. 59-65.
Gardner et al., "Use of Inertance in Orifice Pulse Tube Refrigerators", Cryogenics, vol. 37, No. 2 (1997) pp. 117-121.

* cited by examiner

*Primary Examiner*—William C Doerrler
(74) *Attorney, Agent, or Firm*—David M. Rosenblum

(57) ABSTRACT

Method of controlling a pulse tube cryocooler in which the power input to the acoustic source is varied to maintain temperature of a refrigeration load or a temperature that is at least referable to the temperature of the refrigeration load, at a set point temperature. Additionally, the impedance of an inertance network of the pulse tube cryocooler is also adjusted to obtain a maximum cooling power to the refrigeration load at the particular temperature as sensed and the particular power that is being supplied to the acoustic source.

8 Claims, 4 Drawing Sheets

CONTROL METHOD FOR PULSE TUBE CRYOCOOLER

FIELD OF THE INVENTION

The present invention relates to a method of controlling a pulse tube cryocooler to maintain a refrigeration load at a set point temperature in which the power input to an acoustic source of the pulse tube cryocooler is controlled to maintain the set point temperature and the impedance of an inertance network of the pulse tube cryocooler is adjusted to obtain a maximum cooling power to the refrigeration load at the refrigeration load temperature.

BACKGROUND OF THE INVENTION

Pulse tube cryocoolers consist of a pulse wave generator, which converts electrical energy to acoustic energy, a coldhead which utilizes the acoustic energy to pump heat from a refrigeration load to a warmer heat sink and an inertance network for generating proper phase angle between gas flow and pressure oscillation within the coldhead.

Typically, a non-linear motor is used as the acoustic source and is referred to as a pulse wave generator. The pulse wave generator, coldhead and the inertance network are charged with a gas such as helium. The coldhead has cold and hot heat exchangers to refrigerate a load and to dissipate heat, respectively. The inertance network is typically in the form of a restriction, a compliance volume and an inertance tube connected to the coldhead opposite to the pulse wave generator. The aftercooler is one of the warm heat exchangers in the coldhead and it is used to remove the heat of compression produced by the acoustic source and energy dissipated in the regenerator. The regenerator is a component of the coldhead located between the cold heat exchanger and the aftercooler to absorb the heat from the gas in the compression part of the cycle and to return heat to the gas on the expansion part of the cycle while the gas is reciprocating through the regenerator due to the acoustic wave. The net effect of this process is that heat can be pumped by the gas in the regenerator from a lower temperature area to a higher temperature area.

The operation of the coldhead relies on the proper phasing between the oscillating pressure and the mass flow in the regenerator and thermal buffer tube to pump heat from the lower temperature to the higher temperature. The coldhead and the inertance network have a complex impedance that allows the pulse wave generator to be operated near electromechanical resonance. The conditions at which the coldhead is being run, for instance, refrigeration load, input power, charge pressure affect the complex impedance of the coldhead and inertance network combination and thus the matching of the coldhead with the pulse wave generator. If the pulse wave generator to coldhead and inertance network matching is poor, the pulse wave generator's electric to acoustic energy conversion efficiency will be diminished and the acoustic power that the pulse wave generator is able to generate is therefore reduced. Less acoustic power delivered to the coldhead typically translates into less heat being pumped by the cryocooler and lower cooling capacity.

In the prior art, it is known to control the fine tuning of the inertance network of a pulse tube cryocooler by effectively adjusting the phase between the oscillating pressure and flow in the coldhead. This allows the cryocooler to optimally function and thereby deliver a maximum amount of cooling power to a refrigeration load as is possible. In U.S. Pat. No. 6,666,033, this is achieved by either heating or cooling the flow in a flow restrictor of the inertance network. The heating and cooling of this component changes the temperature, and thus the viscosity and the density of the working fluid in the pulse tube cryocooler. Changing the temperature of the working fluid in the inertance network causes a change in complex impedance of the inertance network components and thus the phase between the oscillating pressure and the flow in the coldhead. In a particular embodiment, an external jacket is provided around the inertance tube and flow restrictor. Control is achieved by the use of adjustable valves to modulate the flow. Heating is achieved by the use of electrical heaters in the cooling jacket. The heating or cooling is controlled in response to the axial temperature profile of the pulse tube by a sensor and a controller.

U.S. Pat. No. 6,021,643 discloses the use of an inertance tube in series with a compliance vessel for an inertance network. A trombone-like sliding tube system can be used to change the dimensions of the inertance tube and thereby provide for a variable complex impedance for tuning the pulse tube cryocooler.

U.S. Patent Application 2006/0086098 describes a method to dynamically adjust the phasing in a regenerative cryocooler such as a pulse tube cryocooler. The cryocooler has a pulse tube, a regenerator, a compressor, and an inertance network. In this patent, the means for adjusting the phasing is through the use of a variable flow restrictor in the inertance network that is constructed using micro electromechanical systems. These flow restrictors may be adjusted dynamically during the operation of a pulse tube cryocooler to allow for optimum cooling during both fast cool down or for steady state operation.

Pulse tube cryocoolers are typically designed for a single narrowly defined operating condition, for example, to cool a refrigeration load to a specific temperature with a specific cooling power equivalent to the heat load. The prior art, discussed above, allows for the dynamic, if not automated control, of the impedance network for the purpose of optimizing the operation of the pulse tube cryocooler to obtain a maximum amount of cooling power from the pulse tube cryocooler under various operational conditions.

The refrigeration load, in practice, can either increase or decrease. This will result in either an increase or decrease in the temperature of the refrigeration load if no adjustment is made to cause a change in the cooling power being delivered by the cryocooler to accommodate the change in the refrigeration load. In either situation, there exists the need to control the pulse tube cryocooler to maintain a set point temperature for the refrigeration load to prevent temperature excursions from the set point. It is also very conceivable for some applications that the set point may be changed or that the cryocooler may be operated in transient conditions where the cryocooler is being used to lower the temperature of the refrigeration load as opposed to just holding a set point. The input power to the acoustic source can be adjusted to change the cooling power being delivered by the cryocooler. Any adjustment of the input power to the cryocooler and refrigeration load temperature away from the design input power and refrigeration load temperature will result in an inefficiency that can become more apparent in large installations.

As will be discussed, the present invention provides a method of controlling a pulse tube cryocooler to maintain the refrigeration load at a set point temperature or to move a refrigeration load to a set point temperature and that ensures a rapid response to increases in the temperature of the refrigeration load.

SUMMARY OF THE INVENTION

The present invention provides a method of controlling a pulse tube cryocooler to maintain a refrigeration load at a set point temperature or to move a refrigeration load towards the set point temperature. In this regard, what is meant herein and in the claims by moving "a refrigeration load towards a set point temperature" is a situation in which the refrigeration load is at a temperature that is different from a desired set point temperature, for example, if the refrigeration load is warm and the cryocooler has just been started or if the set point temperature has been changed, then once a set point temperature has been registered, the refrigeration load temperature is moved to the set point temperature. This is to be contrasted to a situation in which a set point temperature has been set and the same is to be maintained. In such case the set point temperature has been reached and adjustments are made as determined by the control system to account for process variability to hold that set point temperature.

In accordance with this method, a temperature is sensed that is referable to refrigeration load temperature of the refrigeration load. The input power is controlled to the acoustic source of the pulse tube cryocooler by increasing the power input when the temperature rises above the set point temperature and by reducing the power input when the temperature falls below the set point temperature. The impedance of an inertance network of the pulse tube cryocooler is also adjusted to obtain a maximum cooling power output to the refrigeration load from the pulse tube cryocooler at the temperature referable to the refrigeration load temperature and at the power input to the acoustic source.

In such manner, whether the refrigeration load temperature and input power to the cryocooler are at the design condition for the pulse tube cryocooler or not, as the refrigeration load varies and therefore the sensed temperature, not only will the power input of the acoustic source of the cryocooler be varied but also impedance of the inertance network. As a result, less power will be required due to the fact that the pulse tube is operating at a higher efficiency in delivering refrigeration. Moreover, since the pulse tube under all circumstances of power and refrigeration load temperature is delivering a higher cooling power output, as temperature rises and more cooling power is required, the set point temperature can be more rapidly reached than had the power input been controlled alone.

The temperature referable to refrigeration load temperature can be sensed by a temperature transducer. The power input to the acoustic source can be supplied by a variable power supply responsive to a power control signal to increase or decrease the power input. The power control signal in turn is generated by a feedback driven controller connected to the temperature transducer and programmed with a set point temperature to vary the power control signal to increase and decrease the power input as the temperature sensed by the temperature transducer rises above and falls below the set point temperature, respectively.

The impedance of the inertance network can be adjusted by a variable position actuator to adjust an impedance component of the inertance network in response to an impedance control signal. The impedance control signal can be generated by a programmable logic control that is responsive to the power control signal and the temperature transducer. Such logic control is programmed with a family of data relating the power input, the temperature sensed by the temperature transducer and an optimum adjustment of the impedance component that will obtain the maximum cooling power output and to generate the impedance control signal in accordance with the family of data such that the impedance component will be adjusted to the optimum adjustment upon response of the variable position actuator to the impedance control signal.

The feedback driven controller can preferably be a proportional, integral, differential controller. The inertance network includes a flow restriction, a compliance volume and an inertance tube typically connecting the flow restriction and the compliance volume. The impedance component that is adjusted can be the flow resistance of the flow restriction. Preferably, the temperature that is sensed is the temperature of the cold heat exchanger of the pulse tube cryocooler that is in a heat transfer relationship to the refrigeration load.

BRIEF DESCRIPTION OF THE DRAWINGS

While the specification concludes with claims distinctly pointing out the subject matter that applicants regard as their invention, it is believed that the invention will be better understood when taken in connection with accompanying drawings in which:

In order to avoid repetition in the explanation of the drawings, the same reference numerals have been used in the various figures for elements having the same description.

DETAILED DESCRIPTION

Figure 1:
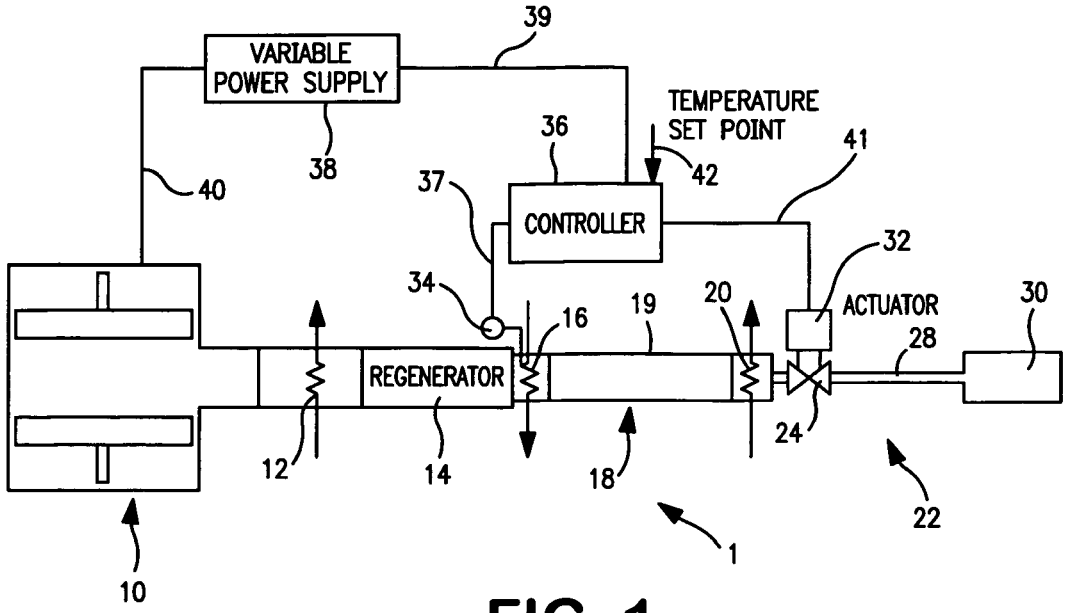
FIG. 1 is a schematic diagram of a pulse tube cryocooler having a control system for carrying out a method in accordance with the present invention.

With reference to FIG. 1, a pulse tube cryocooler 1 is illustrated that is controlled in accordance with the present invention. Pulse tube cryocooler 1 is provided with an acoustic source in the form of a pulse wave generator 10 that can utilize a linear motor to generate pulsations within a gas contained within pulse tube generator 1. Such gas can be for example, neon or helium. Located within the coldhead 18 is an after cooler 12 a regenerator 14, a cold heat exchanger 16, a thermal buffer tube 19 and a warm heat exchanger 20.

The tuning of the pulse tube cryocooler is accomplished with an inertance network 22 that is provided with a variable flow restrictor 24, an inertance tube 28 and a compliance vessel 30.

During operation, the acoustic source 10 generates an acoustic wave that is propagated within coldhead 18. As the wave traverses coldhead 18, the heat of compression, acoustic energy dissipated in the regenerator 14 and heat pumped by the action of the acoustic wave in the regenerator 14 is removed by after-cooler 12.

As gas oscillates through the regenerator 14, heat from the gas in the compression part of the acoustic cycle is absorbed by the regenerator 14 as the gas is moving towards the end of the regenerator 14 adjacent to the after-cooler 12. Heat in the regenerator 14 is then returned to the gas on the expansion part of the acoustic cycle as the gas is moving towards the regenerator 14 adjacent to the cold heat exchanger 16. The net effect of this process is that heat is pumped from the cold heat exchanger 16 to the after-cooler 12 where that heat is rejected. The gas further oscillates through thermal buffer tube 19 to warm heat exchanger 20 where heat is also rejected at warm heat exchanger 20. The heat rejected by warm heat exchanger 20 is primarily from energy dissipated in the inertance network 22. The function of the thermal buffer tube is to insulate the cold heat exchanger 16 from warm heat exchanger 20 with a plug of oscillating gas.

Tuning or the adjustment of the phase between the pressure and the velocity of the gas is adjusted within inertance network 22 in which the impedance is adjusted by flow restrictor valve 24 that has a variable orifice size that is varied by a valve operator 32. As will be discussed, the temperature of the refrigeration load is sensed by a temperature sensor 34 that generates a temperature signal that is fed as an input into a controller 36 through a conductor 37. Controller 36 can be a programmable logic controller and temperature sensor 34 can be a thermocouple.

Controller 36 generates a power control signal 66 to be discussed that is fed to a variable power supply 38 through an electrical conductor 39 to adjust the power input to acoustic source 10 by way of a power lead 40 in response to the temperature sensed by temperature sensor 34. At the same time, in response to the particular power control signal 66 and a temperature signal 60 referable to sensed temperature of temperature sensor 34, an impedance control signal 70, also generated by controller 36, is fed to valve controller 32 by way of an electrical conductor 41. Controller 36 adjusts the power control signal 66 and the inertance network control signal 70 to maintain the temperature of cold heat exchanger 16 at a temperature set point 42 that is also fed as an input to controller 32.

Figure 2:
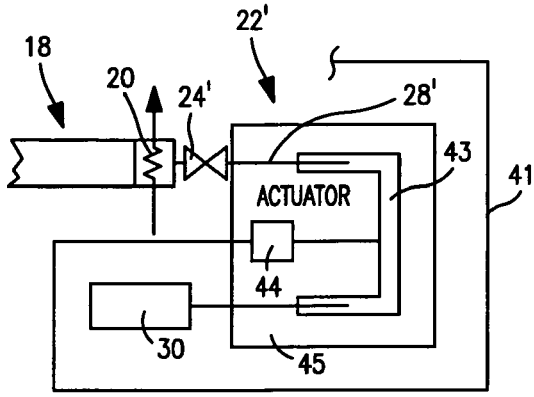
FIG. 2 is a fragmentary view of an alternative embodiment of FIG. 1.

With reference to FIG. 2, in an alternative embodiment, an inertance network 22' can be provided having a fixed flow restriction 24' and an inertance tube 28' having an adjustable length by provision of a sliding section 43 that is driven by an actuator 44 to slide section 43 toward and away from actuator 44 and thereby adjust the length of inertance tube 28'. In such embodiment, the inertance tube 28 is retained in a pressurized chamber 45.

Figure 3:
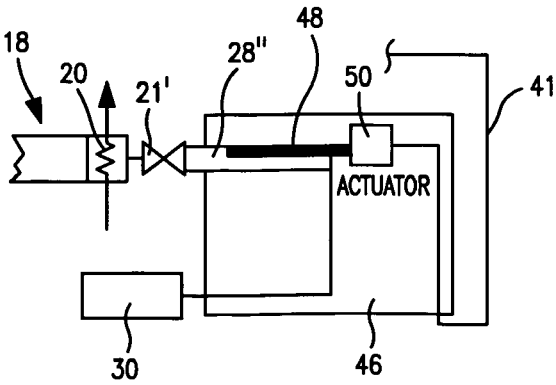
FIG. 3 is a fragmentary view of an alternative embodiment of FIG. 1.

With reference to FIG. 3, an inertance tube 28" can be housed in a pressurized chamber 46 and a sliding piston 48, positioned within inertance tube 28", is driven by an actuator 50 to move piston 48 and thereby change the volume of inertance tube 28.

Figure 4:
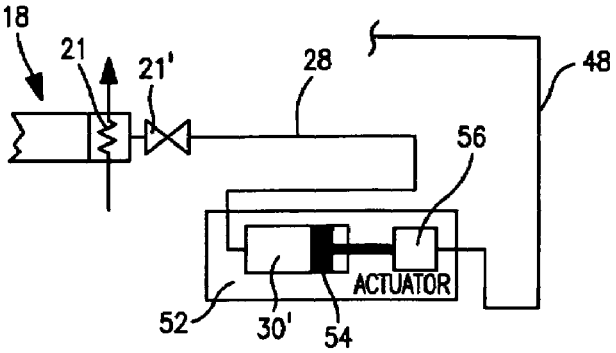
FIG. 4 is fragmentary view of an alternative embodiment of FIG. 1.

With reference to FIG. 4, a compliance vessel 30' can be housed within a pressurized chamber 52 and a piston 54 can be positioned within compliance vessel 30 that is manipulated by an actuator 56 moving the piston 54 by actuator 56 will change the volume of compliance vessel 30 and thereby also change the impedance of the inertance.

As can be appreciated, one or more of the forgoing variable elements could be included in a possible embodiment of the present invention, for example, a variable flow restriction 24 coupled with a variable inertance tube or, for example, inertance tube 28' or 28" and a variable compliance volume 30'. Moreover, in place of the variable flow restriction 24, provided by a valve, a micro-electronic mechanism could be used as well as a heating mechanism of the prior art discussed above. A more direct mechanism that can be used to vary inertance is the variable flow restrictor illustrated in FIG. 1 which is simply an actuated valve 24.

Figure 5:
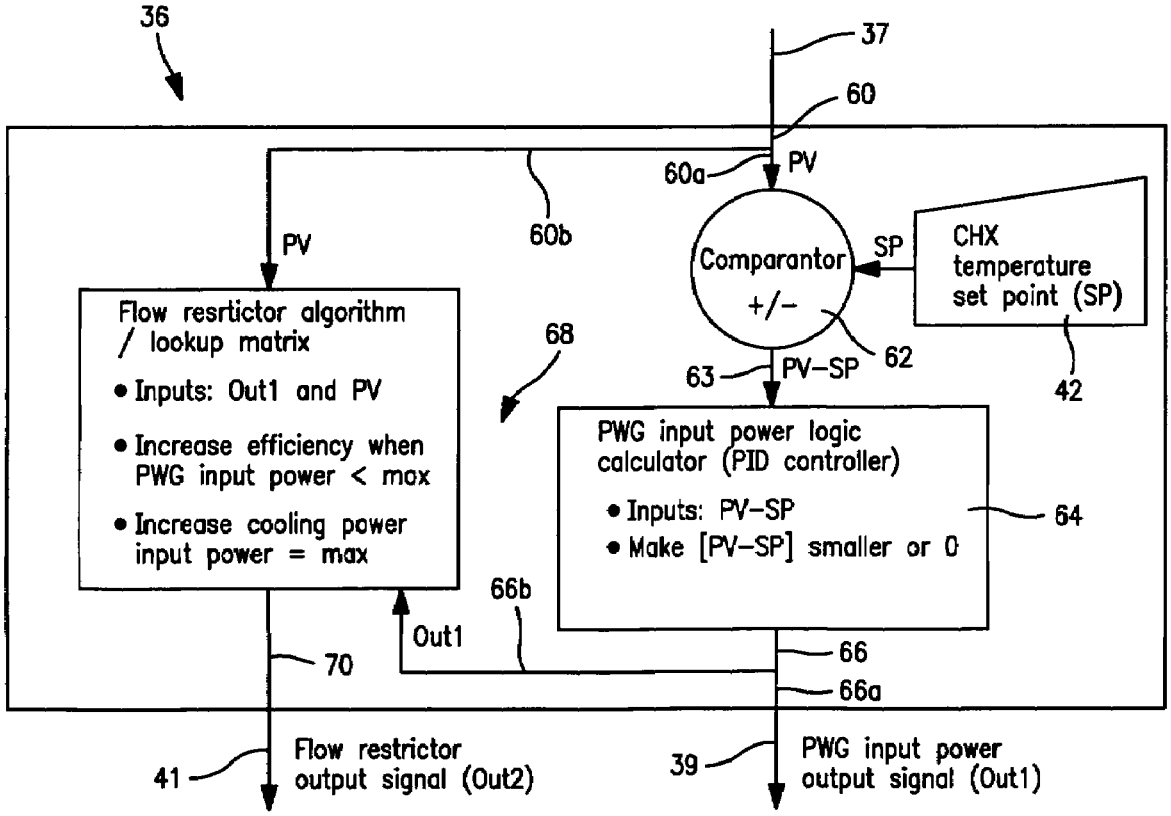
FIG. 5 is a schematic diagram of the control system utilized in FIG. 1.

With reference to FIG. 5, controller 36 is provided with both proportional, integral and differential control to generate the power input control signal 66 as well as a program designed to access lookup tables or a correlation and thereby to generate the inertance network control signal 70. Programmable logic controllers are commercially available that can easily perform the functions as described here from manufacturers such as Allen-Bradley available from Rockwell Automation, 1201 South Second Street, Milwaukee, Wis. 53204-2496 USA and Eaton's Cutler-Hammer business unit located at 1000 Cherrington Parkway, Moon Township, Pa. USA.

A temperature signal 60, referable to the temperature sensed by temperature sensor 34, is fed into an input signal **60*a* into a comparator 62 in which the signal is compared to a signal representing the temperature set point 42. The difference between such signals is fed as an input signal 63 into a proportional, integral and differential controller 64 that generates the power input control signal 66 to minimize the difference the coldhead temperature 34 and the coldhead temperature set point 40. Power input control signal 66 is fed to variable power supply 39 as a control signal 66*a***.

The temperature signal 60, referable to the temperature sensed by temperature sensor 34, is also fed as an input signal **60*b* to a program 68 along with an input signal 66*b* that constitutes the power input control signal 66. Programmed within program 68 is a lookup table containing data shown in FIG. 6 in which power input and the sensed temperature is related to the size of flow restriction provided by flow restriction valve 24. In this regard, the various curves of FIG. 6 relate the sensed temperature to optimum orifice size or the flow restriction provided by flow restriction valve 24 as a percentage to the at various percentiles of maximum input power ("nondim" input powers "We") to the acoustic source 10. The particular pulse tube cryocooler 1 is designed to operate at its cold end at about 77° K at 100 output percent power as shown by the solid line. It is to be noted that there are operational limits on the cryocooler 1 or any cryocooler for that matter using an acoustic source as described here. These limits typically are input power (We), piston stroke (X) and input current (I). The simple dashed line that touches the solid line is produced for a condition where one or more of these three conditions are at their upper limit. Some point on the line may be at maximum stroke and some may be at maximum input power for example. This is because for operating conditions away form the design point, the maximum input power may not be attainable because of a stroke or current limit. In any event, should the power input to acoustic source 10** lie between lines, the programming will interpolate the power at a given temperature to select the appropriate flow restriction or orifice size. Here it is to be noted that such map or family of power curves can be obtained through modeling optimization or empirically by suitable experimentation.

If experimentation is used to generate the family of data, the cryocooler will be run at a constant power level and the inertance network setting will be varied. The object of the testing will be to find the inertance network setting that produces the maximum cooling power at a particular temperature and input power. The refrigeration load will be adjusted after each inertance network setting change to allow the refrigeration load temperature to stabilize at the target temperature. This process can then be repeated at constant input power for other refrigeration load temperatures. The process will then be further repeated for other input power conditions and the maximum acoustic output power condition where either input power, stroke or current for the acoustic source is at a maximum limit. The result of this testing will be a data set where if all of the optimum (highest cooling power for each input power and refrigeration load temperature) conditions were plotted, the result would be a family of data such as depicted in FIG. 6 and FIG. 7 (discussed below).

Figure 6:
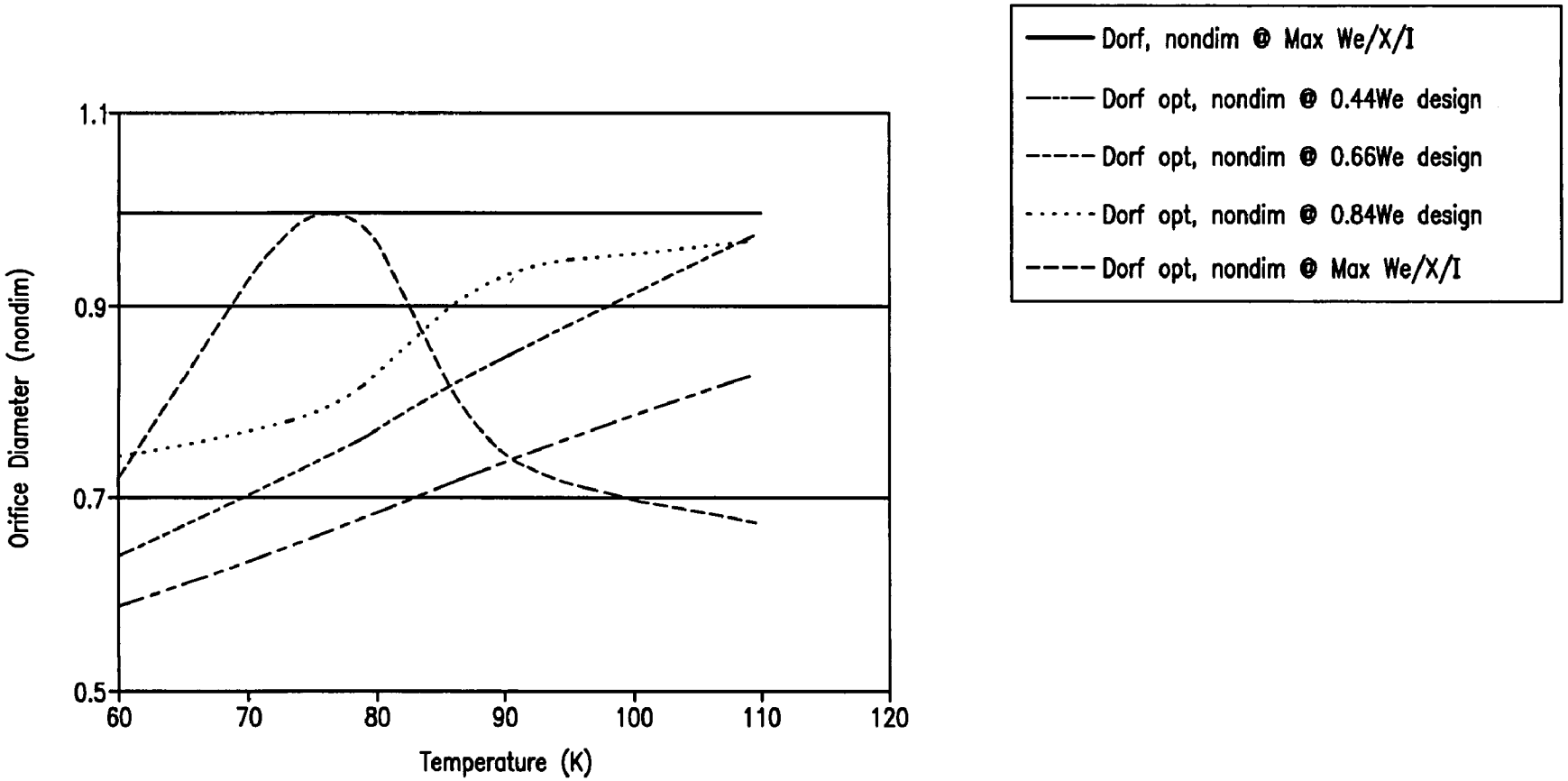
FIG. 6 is graphical representation or map of the data utilized in the controller of FIG. 5 relating to power input, temperature of the refrigeration load and flow restriction size.
Figure 7:
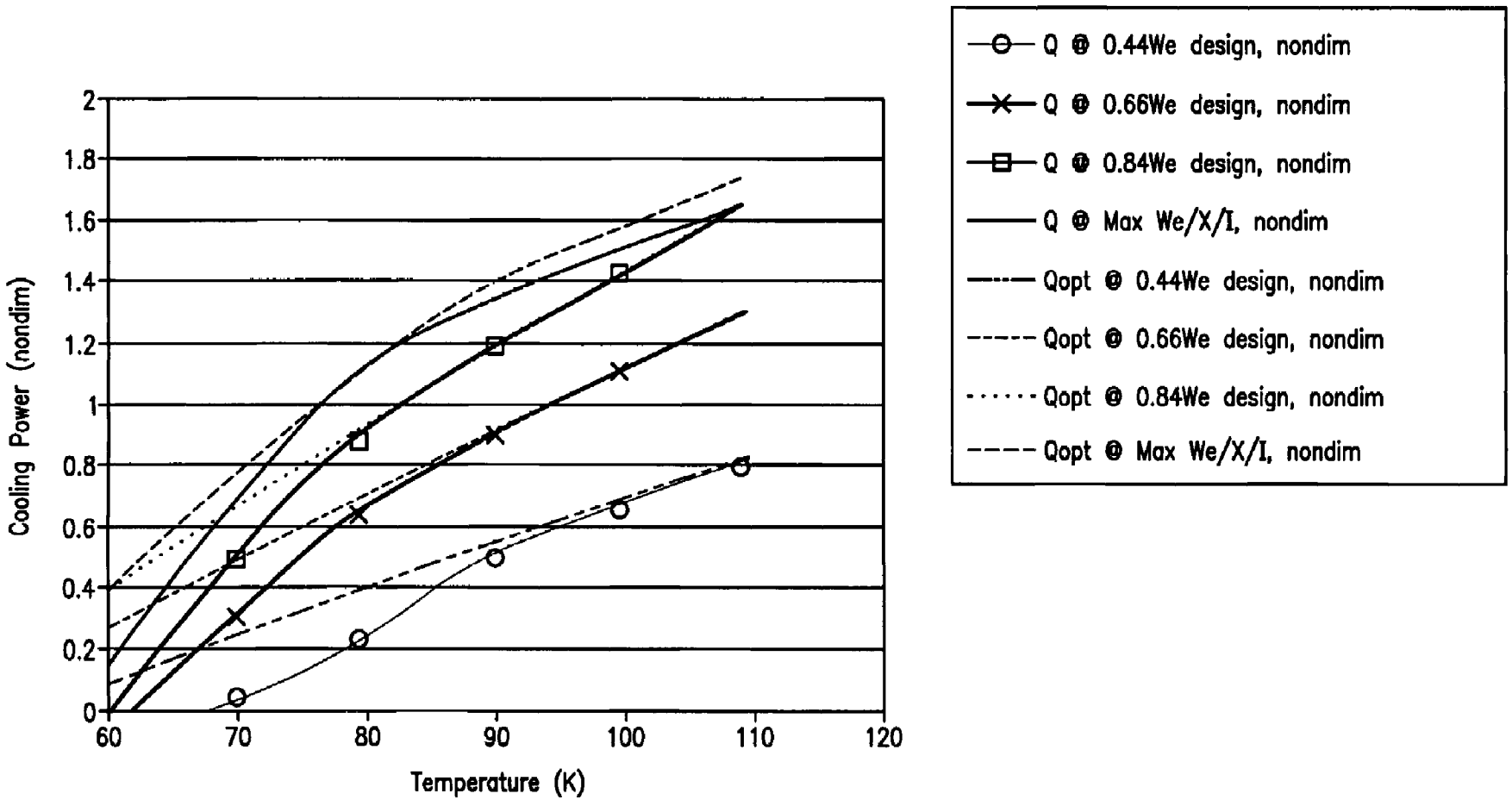
FIG. 7 is a graphical representation or map of cooling power provided by a cryocooler in which the cooling power that is achieved at particular power settings is compared with fixed flow restriction and optimally sized flow restriction to achieve the maximum cooling power at a particular refrigeration load temperature.

With brief reference to FIG. 7, the cooling power that can be achieved by cryocooler 1 with a fixed orifice is compared with the optimum cooling power ("opt") that can be achieved through adjustment of the size of the flow restriction with power and temperature. As is apparent, depending on the input power "We" to the acoustic source and the particular operational temperature, more cooling power can be achieved by optimizing the flow restriction for the particular power and temperature to result in a more rapid response for cryocooler 1 to a change in temperature of the refrigeration load. In this regard, the "nondim" or non dimensional cooling power represents the actual cooling power divided by the design cooling power at the design refrigeration load temperature. The cooling power is the thermal energy per unit time that is being removed from the refrigeration load. The other variables have been discussed with respect to FIG. 6.

The output resulting from such data, as graphically represented in FIG. 6, is the inertance network control signal 70 that is referable to the orifice size and that is fed to valve controller 32 via electrical conductor 41 to adjust the flow restriction provided by flow restriction valve 24. Thus, assuming that the temperature sensed is warmer than the temperature set point 40, the difference produced by comparator 62 will be positive and the resulting power control signal 66 will generally cause the variable power supply 38 to feed more power to acoustic source 10. This will increase the generation of cooling power, thereby to decrease the temperature of cold heat exchanger 16. At the same time, an optimal inertance will be produced by inertance control signal 70 that is fed to valve controller 32. Thus, maximum cooling power will be produced by pulse tube cryocooler 1. As a result, less power will be used and the time for pulse tube cryocooler 1 to obtain the temperature set point will be reduced. If the opposite occurs, namely the temperature sensed by temperature sensor 34 is less than the temperature set point, the power input control signal 70 will generally act to reduce the amount of power applied to acoustic source 10 via variable power source 38. Control program 68 will generate an inertance network control signal 70 to again tune the impedance network 22 at the particular power and sensed temperature.

Although cold heat exchange temperature 16 is sensed as the temperature fed into controller 36, the temperature of the refrigeration load itself, could be directly sensed to control pulse tube cryocooler 1. Additionally, although the power input control signal 66 is fed into the program 68, the power output of variable power supply 38 could serve as an alternative input to program 66.

While the invention has been described with reference to a preferred embodiment, numerous additions, and omissions may be made without departing from the spirit and scope of the present invention as set forth in the appended claims.

I claim:

1. A method of controlling a pulse tube cryocooler to maintain a refrigeration load at a set point temperature or to move a refrigeration load towards the set point temperature, said method comprising:

sensing a temperature referable to refrigeration load temperature of the refrigeration load;

controlling power input to an acoustic source of the pulse tube cryocooler by increasing the power input when the temperature rises above the set point temperature and reducing the power input when the temperature falls below the set point temperature; and adjusting impedance of an inertance network of the pulse tube cryocooler in response to the temperature referable to the refrigeration load temperature and the power input to the cryocooler such that a maximum cooling power to the refrigeration load is obtained from the pulse tube cryocooler at the temperature referable to the refrigeration load temperature and at the power input to the acoustic source.

2. The method of claim 1, wherein:

the temperature referable to the refrigeration load temperature is sensed by a temperature transducer;

the power input to the acoustic source is supplied by a variable power supply responsive to a power control signal to increase or decrease the power input; and the power control signal is generated by a feed back driven controller connected to the temperature transducer and programmed with the set point temperature to vary the power control signal to increase and decrease the power input as the temperature sensed by the temperature transducer rises above and falls below the temperature set point, respectively.

3. The method of claim 2, wherein:

the impedance of the inertance network is adjusted by a variable position actuator to adjust an impedance component of the inertance network in response to an impedance control signal; and the impedance control signal is generated by a programmable logic controller responsive to the power control signal and the temperature transducer and programmed with a family of data relating the power input, the temperature sensed by the temperature transducer and an optimum adjustment to the impedance component that will obtain the maximum cooling power and to generate the impedance control signal in accordance with the family of data such that the impedance component will be adjusted to the optimum adjustment upon response of the variable position actuator to the impedance control signal.

4. The method of claim 3, wherein the feed back driven controller is a proportional, integral, differential controller.

5. The method of claim 3, wherein the inertance network includes a flow restriction, a compliance volume and an inertance tube connecting the flow restriction and the compliance volume and the impedance component being adjusted is flow resistant of the flow restriction.

6. The method of claim 4, wherein the inertance network includes a flow restriction, a compliance volume and an inertance tube connecting the flow restriction and the compliance volume and the impedance component being adjusted is flow resistance of the flow restriction.

7. The method of claim 1, wherein the temperature that is sensed is the temperature of a cold heat exchanger of the pulse tube cryocooler in a heat transfer relationship to the refrigeration load.

8. The method of claim 6, wherein the temperature that is sensed is the temperature of a cold heat exchanger of the pulse tube cryocooler in a heat transfer relationship to the refrigeration load.

* * * * *